US009763292B2

(12) United States Patent
Kang et al.

(10) Patent No.: US 9,763,292 B2
(45) Date of Patent: Sep. 12, 2017

(54) BACKLIGHT UNIT

(71) Applicant: Samsung Display Co., Ltd., Yongin-si, Gyeonggi-Do (KR)

(72) Inventors: Wonhyoung Kang, Asan-si (KR); Mingyu Kim, Asan-si (KR); Taegon Im, Gyeonggi-do (KR); Songyi Han, Asan-si (KR); Jintaek Hong, Asan-si (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 0 days.

(21) Appl. No.: 14/841,464

(22) Filed: Aug. 31, 2015

(65) Prior Publication Data

US 2016/0143103 A1 May 19, 2016

(30) Foreign Application Priority Data

Nov. 19, 2014 (KR) ..... 10-2014-0161749

(51) Int. Cl.

| | |
|---|---|
| ***H05B 37/02*** | (2006.01) |
| ***H05B 33/08*** | (2006.01) |
| ***G09G 3/34*** | (2006.01) |
| ***H05B 37/03*** | (2006.01) |

(52) U.S. Cl.

CPC ..... *H05B 33/0815* (2013.01); *G09G 3/3406* (2013.01); *G09G 3/3426* (2013.01); *H05B 33/089* (2013.01); *H05B 33/0845* (2013.01); *H05B 33/0851* (2013.01); *H05B 37/029* (2013.01); *H05B 37/0245* (2013.01); *H05B 37/0263* (2013.01); *H05B 37/032* (2013.01)

(58) Field of Classification Search

CPC H05B 37/02; H05B 33/0815; H05B 33/0845; H05B 33/0851; H05B 33/089; H05B 37/0245; H05B 37/0263; H05B 37/029; H05B 37/032; G09G 3/3406; G09G 3/3426

USPC ..... 315/307, 308, 312, 360; 345/102

See application file for complete search history.

(56) References Cited

U.S. PATENT DOCUMENTS

| | | | | |
|---|---|---|---|---|
| 2006/0109389 | A1* | 5/2006 | Ichikawa | G09G 3/342 349/1 |
| 2010/0019697 | A1* | 1/2010 | Korsunsky | H05B 33/0818 315/307 |
| 2011/0215731 | A1* | 9/2011 | Jeong | H05B 33/0854 315/254 |

(Continued)

FOREIGN PATENT DOCUMENTS

| | | | |
|---|---|---|---|
| KR | 1020110072692 | A | 6/2011 |
| KR | 1020120010482 | A | 2/2012 |

(Continued)

*Primary Examiner* — Tung X Le

(74) *Attorney, Agent, or Firm* — Robert E. Bushnell, Esq.

(57) ABSTRACT

A backlight unit includes: a light source configured to emit light based on a driving current; and a backlight controller receiving a digital dimming signal that defines a length of an output period of the driving current from a pulse width modulator and configured to, when a duty ratio of the driving current is less than a reference duty ratio, modulates the duty ratio of the driving current so that the duty ratio of the driving current is equal to or greater than the reference duty ratio and decrease a duty ratio of the digital dimming signal.

15 Claims, 13 Drawing Sheets

(56) References Cited

U.S. PATENT DOCUMENTS

| | | | | |
|---|---|---|---|---|
| 2012/0049753 | A1 | 3/2012 | Hwang et al. | |
| 2013/0250215 | A1* | 9/2013 | Sasaki | H05B 33/0815 349/69 |
| 2014/0176015 | A1* | 6/2014 | Suzuki | H05B 33/0803 315/307 |
| 2014/0368129 | A1* | 12/2014 | Fukuda | H05B 33/0818 315/297 |
| 2015/0124003 | A1* | 5/2015 | Mio | G09G 3/3406 345/690 |

FOREIGN PATENT DOCUMENTS

| | | | |
|---|---|---|---|
| KR | 1020120019642 | A | 3/2012 |
| KR | 101365362 | B | 2/2014 |
| KR | 1020140076098 | A | 6/2014 |

* cited by examiner

BACKLIGHT UNIT

CLAIM OF PRIORITY

This application claims priority to and the benefit of Korean Patent Application No. 10-2014-0161749, filed on Nov. 19, 2014, with the Korean Intellectual Property Office, the disclosure of which is incorporated herein in its entirety by reference.

BACKGROUND OF THE INVENTION

1. Field of Disclosure

Embodiments of the present invention generally relate to a backlight unit capable of stably driving a light source using a constant direct current voltage.

2. Description of the Related Art

Liquid crystal display (LCD) devices utilize liquid crystal molecules, which are non-light emitting elements, such that a backlight unit is required in order to produce light.

The backlight unit may include a plurality of light source arrays including a plurality of light emitting diodes (LEDs).

The backlight unit may be controlled by a dimming method so as to improve image quality. In the case of dimming control, a voltage level of a direct current (DC) voltage applied to the light source may be adjusted. In order to adjust a voltage level of a DC voltage, conventional backlight units may include a DC-DC converter for a backlight.

The DC-DC converter for the backlight may include an inductor, a switching element, a diode, and a capacitor.

Accordingly, conventional backlight units have a large volume due to the DC-DC converter.

Meanwhile, it is also possible to drive backlight units using a constant DC voltage without a DC-DC converter. In this case, however, the constant DC voltage may bring disadvantages as follows:

When a DC voltage applied to the light source is substantially large, a duty ratio of a driving current is required to be decreased considerably so as to keep a predetermined amount of the driving current. In this case, the light source may not be turned on, when the duty ratio is decreased below a certain value.

It is to be understood that this Related Art section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY OF THE INVENTION

Aspects of embodiments of the present invention are directed to a backlight unit capable of stably performing dimming processes with a constant DC voltage.

According to an exemplary embodiment, a backlight unit includes: a light source configured to emit light based on a driving current; and a backlight controller configured to receive a digital dimming signal that defines a length of an output period of the driving current from a pulse width modulator. The backlight controller, when a duty ratio of the driving current is less than a reference duty ratio, may modulate the duty ratio of the driving current so that the duty ratio of the driving current is equal to or greater than the reference duty ratio and decrease a duty ratio of the digital dimming signal.

The backlight controller may increase the duty ratio of the driving current n times (n is a natural number greater than 1) its original duty ratio and decrease the duty ratio of the digital dimming signal to an nth of its original duty ratio.

The backlight controller may include: a dimming controller configured to, when a duty ratio of the driving current is less than a reference duty ratio, increase voltage of an analog dimming signal and decrease a duty ratio of the digital dimming signal applied from the pulse width modulator; a duty ratio calculator configured to, during a high period of the digital dimming signal applied from the dimming controller, calculate a duty ratio of the driving current and provide the calculated duty ratio to the dimming controller; and a light source controller configured to receive the analog dimming signal and the digital dimming signal from the dimming controller, to increase the duty ratio of the driving current greater than the reference duty ratio in response to the analog dimming signal with an increased voltage, and to apply the driving current to the light source during a high period of the digital dimming signal with a decreased duty ratio.

The dimming controller may increase voltage of the analog dimming signal n times (n is a natural number greater than 1) its original voltage and decrease a duty ratio of the digital dimming signal to an nth of its original duty ratio.

The light source controller may include: a sensing resistor configured to generate a sensing voltage based on the driving current; an integrator configured to integrate the sensing voltage; a first comparator configured to compare the sensing voltage integrated by the integrator and the analog dimming signal applied from the dimming controller to thereby generate a first comparison signal, and to output the first comparison signal during a high period of a second comparison signal; an oscillator configured to output a ramp signal; a second comparator configured to compare the first comparison signal applied from the first comparator and the ramp signal applied from the oscillator to generate output a second comparison signal, and to output the second comparison signal during a high period of the digital dimming signal applied from the dimming controller; and a static current switching element configured to control the driving current according to the second comparison signal outputted from the second comparator.

The integrator may include: a resistor connected between the sensing resistor and an input terminal of the first comparator; and a capacitor connected between an output terminal of the first comparator and the input terminal of the first comparator.

The light source controller may further include a voltage divider configured to divide the analog dimming signal applied from the dimming controller and output the divided analog dimming signal to the first comparator.

The backlight unit may further include a DC power source connected to the light source.

The backlight unit may further include: a DC power source; and a voltage converter configured to increase or decrease a DC voltage applied from the DC power source to apply the increased or decreased DC voltage to the light source.

The duty ratio calculator may be connected to one of a cathode terminal and an anode terminal of the light source.

The light source may be a light emitting diode (LED)

According to another exemplary embodiment, a backlight unit includes: a plurality of light sources configured to emit light based on a plurality of driving currents and connected in parallel; and a backlight controller configured to receive a digital dimming signal that defines lengths of output periods of the driving currents from a pulse width modulator. The backlight controller, when at least one of duty ratios of the driving currents is less than a reference duty ratio, may modulates the duty ratio of each driving current so that the duty ratio of each driving current is equal to or greater than the reference duty ratio and decrease the duty ratio of the digital dimming signal.

The backlight controller may increase the duty ratio of each driving current n times (n is a natural number greater than 1) its original duty ratio and decrease the duty ratio of the digital dimming signal to an nth of its original duty ratio.

The backlight controller may include: a dimming controller configured to, when at least one of duty ratios of the driving currents is less than a reference duty ratio, increase voltage of an analog dimming signal and decrease a duty ratio of the digital dimming signal applied from the pulse width modulator; a duty ratio calculator configured to, during a high period of the digital dimming signal applied from the dimming controller, calculate a duty ratio of each of the driving currents and provide the calculated duty ratio to the dimming controller; and a light source controller configured to receive the analog dimming signal and the digital dimming signal from the dimming controller, to increase the duty ratio of each of the driving currents greater than the reference duty ratio in response to the analog dimming signal with an increased voltage, and to apply the driving currents to the light source during a high period of the digital dimming signal with a decreased duty ratio.

The dimming controller may increase voltage of the analog dimming signal n times (n is a natural number greater than 1) its original voltage and decrease the duty ratio of the digital dimming signal to an nth of its original duty ratio.

According to embodiments of the present invention, a backlight unit may have following effects.

When a duty ratio of a driving current becomes less than a predetermined reference duty ratio, a backlight unit according to embodiments of the present invention may increase the duty ratio of the driving current to be greater than the reference duty ratio, but reduce a length of an output period of the driving current. Accordingly, although the DC voltage is substantially large, the duty ratio of the driving current may not be decreased. Further, the output period of the driving current may be reduced in accordance with an increase in the duty ratio of the driving current, thereby achieving proper control of luminance of the light source.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
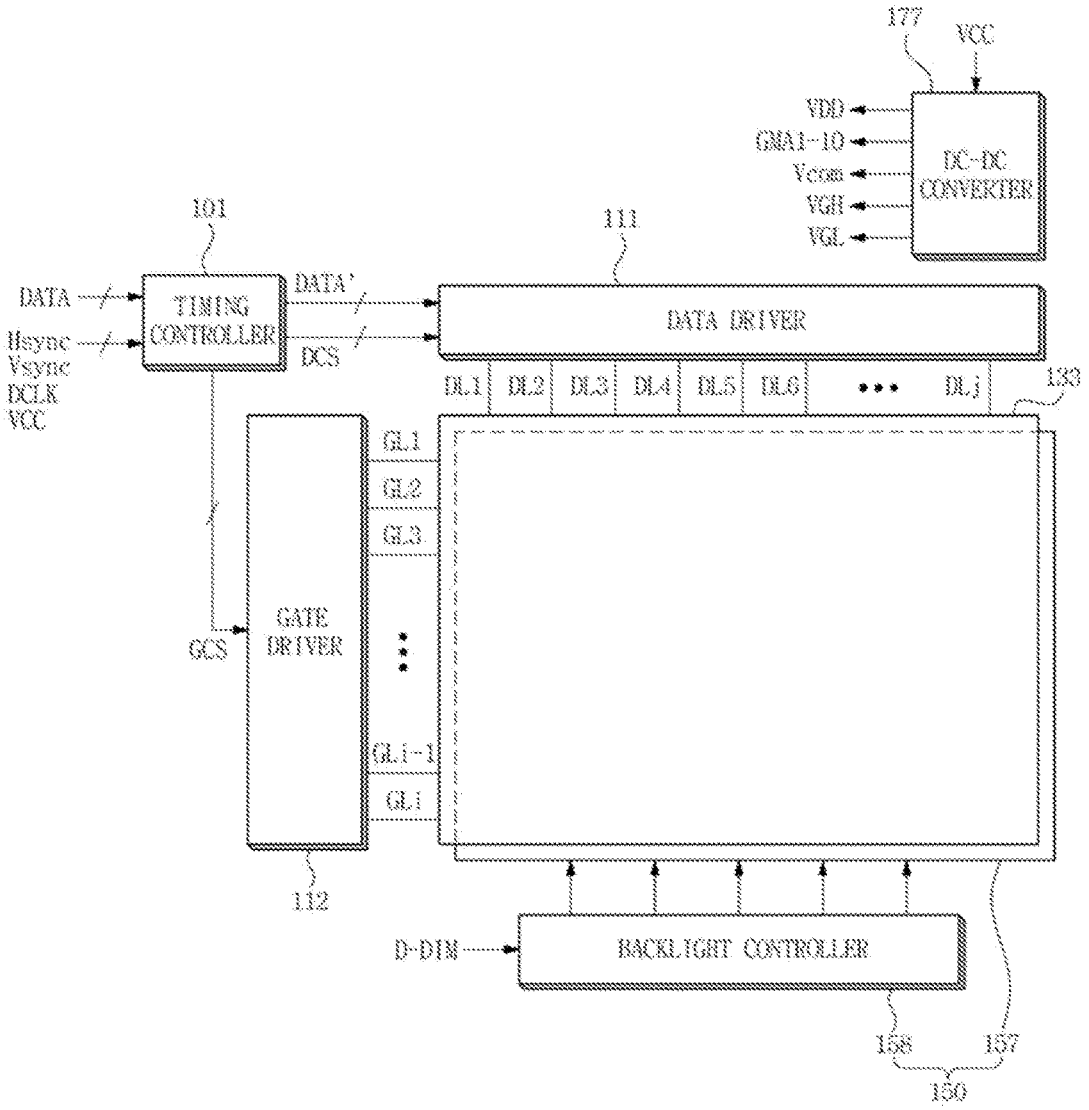
FIG. 1 is a block diagram illustrating a display device according to one exemplary embodiment.

Advantages and features of the present invention and methods for achieving them will be made clear from embodiments described below in detail with reference to the accompanying drawings. The present invention may, however, be embodied in many different forms and should not be construed as being limited to the embodiments set forth herein. Rather these embodiments are provided so that this disclosure will be thorough and complete, and will fully convey the scope of the invention to those skilled in the art. The present invention is merely defined by the scope of the claims. Therefore, well-known constituent elements, operations and techniques are not described in detail in the embodiments in order to prevent the present invention from being obscurely interpreted. Like reference numerals refer to like elements throughout the specification.

In the drawings, thicknesses are illustrated in an enlarged manner in order to clearly describe a plurality of layers and areas. Like reference numbers are used to denote like elements throughout the specification. When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The spatially relative terms "below", "beneath", "lower". "above", "upper", and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device shown in the drawing is turned over, the device positioned "below" or "beneath" another device may be placed "above" another device. Accordingly, the illustrative term "below" may include both the lower and upper positions. The device may also be oriented in the other direction, and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" can be termed likewise without departing from the teachings herein.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Figure 2:
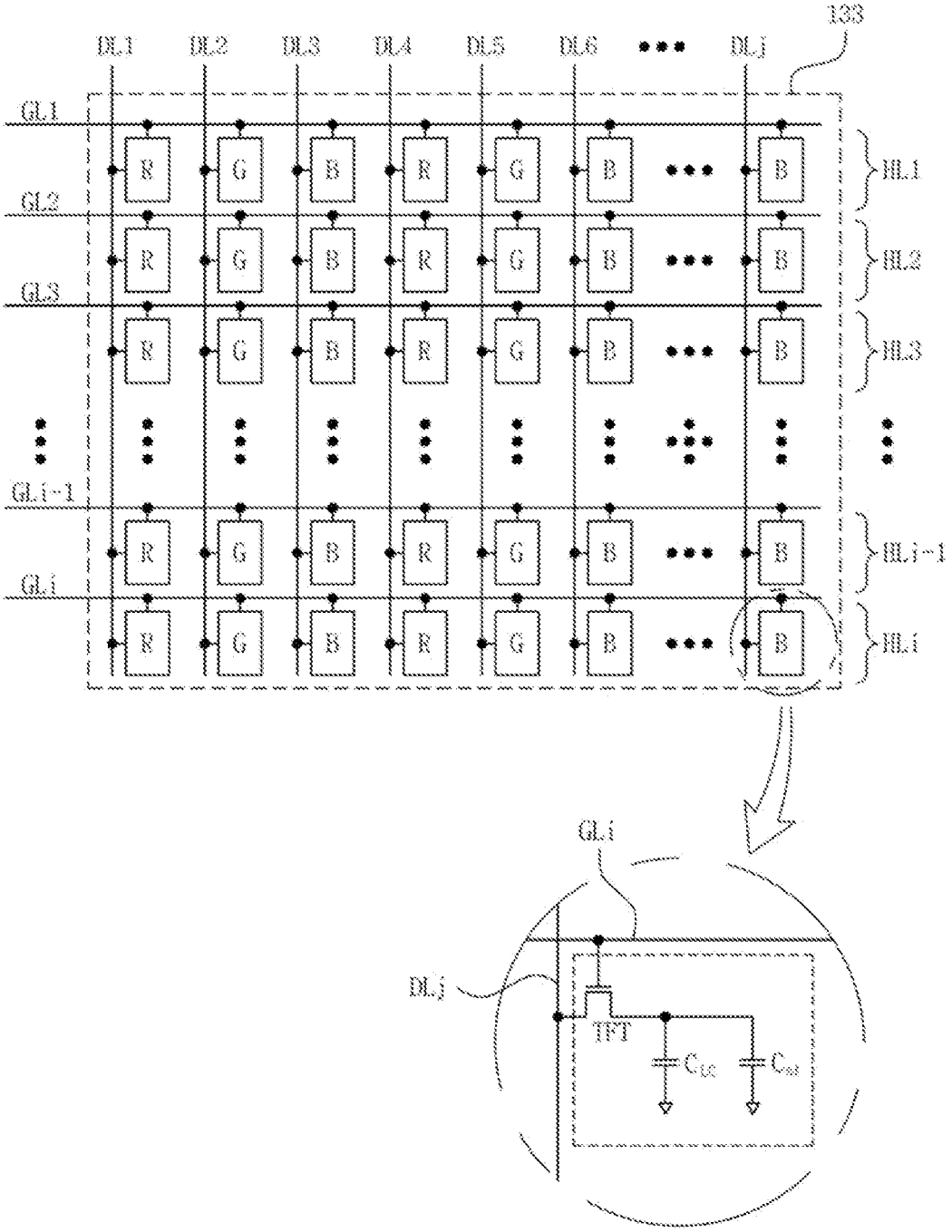
FIG. 2 is a detailed configuration view illustrating a display panel of FIG. 1.
Figure 3:
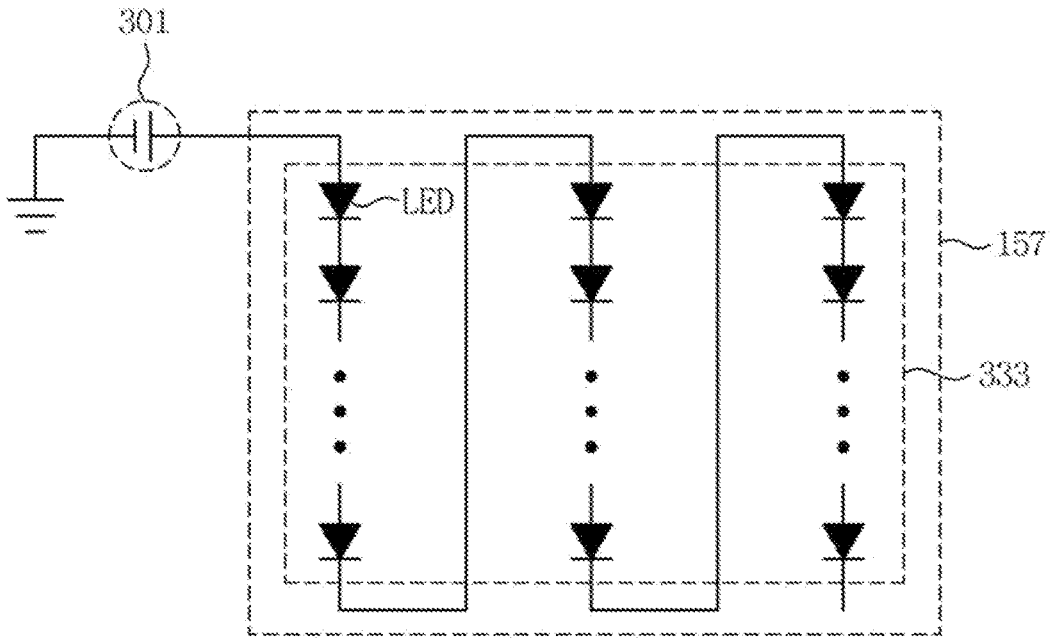
FIG. 3 is a schematic view illustrating a backlight of FIG. 1 according to one exemplary embodiment.

FIG. 1 is a block diagram illustrating a display device according to one exemplary embodiment. FIG. 2 is a detailed configuration view illustrating a display panel of FIG. 1. FIG. 3 is a schematic view illustrating a backlight of FIG. 1 according to one exemplary embodiment.

The display device according to one exemplary embodiment may include, as illustrated in FIG. 1, a display panel 133, a backlight unit 145, a backlight controller 158, a timing controller 101, a gate driver 112, a data driver 111, and a DC-DC converter 177.

The display panel 133 may be configured to display images. The display panel 133 may include, although not illustrated, a liquid crystal layer and lower and upper substrates opposed to each other with the liquid crystal layer interposed therebetween.

On the lower substrate, a plurality of gate lines GL1 to GLi, a plurality of data lines DL1 to DLj intersecting the gate lines GL1 to GLi, and thin film transistors (TFTs) connected to the gate lines GL1 to GLi and the data lines DL1 to DLj may be disposed.

Although not illustrated, a black matrix, a plurality of color filters, and a common electrode may be disposed on the upper substrate. The black matrix may be disposed on the upper substrate, except for an area corresponding to a pixel region. The color filters may be disposed on the pixel region. The color filters are categorized into red, green, and blue color filters.

Pixels R, G, and B may be arranged in a matrix form. The pixels R, G, and B are categorized into red pixels R disposed corresponding to the red color filter, green pixels C disposed corresponding to the green color filter, and blue pixels B disposed corresponding to the blue color filter. In this case, the red, green, and blue pixels R, G, and B adjacently disposed in a horizontal direction may form a unit pixel to display a unit image.

J pixels arranged along an nth (n is a number selected from 1 to i) horizontal line (hereinafter, nth horizontal line pixels) may be respectively connected to the first to the jth data lines DL1 to DLj. Further, the nth horizontal line pixels may be connected to the nth gate line together. Accordingly, the nth horizontal line pixels may receive an nth gate signal together. That is, j pixels arranged in the same horizontal line may receive the same gate signal, while pixels arranged in different horizontal lines may receive different gate signals. For example, both red and green pixels R and C disposed on the first horizontal line HL1 may receive a first gate signal, while red and green pixels R and G disposed on the second horizontal line HL2 may receive a second gate signal that has a different timing compared to the first gate signal.

Each of the pixels R, G, and B may include, as illustrated in FIG. 2, a TFT, a liquid crystal storage capacitor CLC, and an auxiliary storage capacitor Cst.

The TFT may be turned on according to a gate signal applied from the gate line. The turned-on TFT may supply an analog image data signal applied from the data line to the liquid crystal storage capacitor CLC and the auxiliary storage capacitor Cst.

The liquid crystal storage capacitor CLC may include a pixel electrode and a common electrode opposed to each other.

The auxiliary storage capacitor Cst may include a pixel electrode and an opposing electrode opposed to each other. Herein, the opposing electrode may be a previous gate line or a common line that may transmit a common voltage.

Meanwhile, among elements forming the pixels R, G, and B, the TFT may be covered by the black matrix.

The timing controller 101 may be configured to receive a vertical synchronization signal Vsync, a horizontal synchronization signal Hsync, an image data signal DATA, and a clock signal DCLK outputted from a graphic controller provided in a system. An interface circuit (not illustrated) may be provided between the timing controller 101 and the system, and the signals outputted from the system are inputted to the timing controller 101 through the interface circuit. The interface circuit may be equipped in the timing controller 101.

Although not illustrated, the interface circuit may include an LVDS receiver. The interface circuit may lower voltage levels of the vertical synchronization signal Vsync, the horizontal synchronization signal Hsync, the image data signal DATA, and the clock signal DCLK outputted from the system, but also increase frequencies of the signals.

Meanwhile, due to a high-frequency component of the signal inputted from the interface circuit to the timing controller 101, electromagnetic interference may be caused therebetween. In order to prevent the interference, an EMI filter (not illustrated) may be further provided between the interface circuit and the timing controller 101.

The timing controller 101 may generate a gate control signal to control the gate driver 112 and a data control signal to control the data driver 111, using the vertical synchronization signal Vsync, the horizontal synchronization signal Hsync, and the clock signal DCLK. The gate control signal may include a gate start pulse, a gate shift clock, a gate output enable signal, and the like. The data control signal may include a source start pulse, a source shift clock, a source output enable signal, a polarity signal, and the like.

Further, the timing controller 101 may rearrange the image data signals DATA inputted from the system and supply the rearranged image data signals DATA' to the data driver 111.

Meanwhile, the timing controller 101 may be operated by a driving power VCC outputted from a power unit provided in the system. In particular, the driving power VCC may be used as a power voltage of a phase lock loop PLL equipped in the timing controller 101. The phase lock loop PLL may compare the clock signal DCLK inputted to the timing controller 101 with a reference frequency generated by an oscillator. In a case where there is a difference between the compared values, the phase lock loop PPL may adjust the frequency of the clock signal by the difference to thereby produce a sampling clock signal. The sampling clock signal is a signal used to perform sampling of the image data signals DATA'.

The DC-DC converter 177 may increase or decrease the driving power VCC inputted through the system to thereby produce voltages required for the display panel 133. For this purpose, the DC-DC converter 177 may include, for example, an output switching element for switching an output voltage of an output terminal thereof; and a pulse width modulator PWM for adjusting a duty ratio or a frequency of a control signal applied to a control terminal of the output switching element so as to increase or decrease the output voltage. Herein, the DC-DC converter 177 may include a pulse frequency modulator PFM, instead of the pulse width modulator PWM.

The pulse width modulator PWM may increase the duty ratio of the above-described control signal to thereby increase the output voltage of the DC-DC converter 177 or decrease the duty ratio of the control signal to thereby lower the output voltage of the DC-DC converter 177. The pulse frequency modulator PFM may increase a frequency of the above-described control signal to thereby increase the output voltage of the DC-DC converter 177 or decrease the frequency of the control signal to thereby lower the output voltage of the DC-DC converter 177. The output voltage of the DC-DC converter 177 may include a reference voltage VDD of about 6[V] or more, a gamma reference voltage GMA1-10 of less than level 10, a common voltage in a range from about 2.5 to 3.3[V], a gate high voltage of about 15[V] or more, and a gate low voltage of −4[V] or less.

The gamma reference voltage GMA1-10 is voltage generated by voltage division of the reference voltage. The reference voltage and the gamma reference voltage are analog gamma voltages, and they are provided to the data driving integrated circuit D-IC. The common voltage may be applied to a common electrode of the display panel 133 via the data driving integrated circuit D-IC. A gate high voltage is a high logic voltage of the gate signal, which may be set to be a threshold voltage or more of the TFT. A gate low voltage may be a low logic voltage of the gate signal, which may be set to be an off voltage of the TFT. The gate high voltage and the gate low voltage are applied to the gate driver 112.

The gate driver 112 may be configured to produce gate signals according to a gate control signal GCS applied from the timing controller 101 and sequentially apply the gate signals to the plurality of gate lines GL1 to GLi. The gate driver 112 may include, for example, a shift register configured to shift a gate start pulse according to a gate shift clock to thereby produce gate signals. The shift register may include a plurality of switching elements. The switching elements may be formed on a front surface of the lower substrate in the same process as in the TFT of a display area.

The data driver 111 may be configured to receive the image data signals DATA' and a data control signal DCS from the timing controller 101. The data driver 11 may perform sampling of the image data signals DATA' according to the data control signal DCS, perform latching of the sampled image data signals corresponding to one horizontal line each horizontal period, and apply the latched image data signals to the data lines DL1 to DLj. That is, the data driver 111 may convert the image data signals DATA' applied from the timing controller 101 into analog image data signals using the gamma reference voltages GMA1-10 inputted from the DC-DC converter 177 and provide them to the data lines DL1 to DLj.

The backlight unit 150 may be configured to provide light to the display panel 133. The backlight unit 150 may include a backlight 157 for emitting light and a backlight controller 158 for controlling the backlight 157.

The backlight 157 may include, as illustrated in FIG. 3, at least one light source (e.g., light emitting diode (LED)). Further, the backlight 157 may be connected between the light source, a DC power source 301 that supplies DC voltage, and the backlight controller 158. The DC power source 301 may generate a DC voltage having a constant value. The light source may emit light by a driving current generated based on the DC voltage and the driving current may be controlled by the backlight controller 158. Meanwhile, when the backlight 157 includes a plurality of light sources, the light sources may be connected to each other in series between the DC power source 301 and the backlight controller 158. In this case, the plurality of light sources connected in series is referred to as a light source array 333.

The light source may be a light emission package including at least one LED. In some embodiments, one light emission package may include a red LED emitting red light, a green LED emitting green light, and a blue LED emitting blue light therein. The light emission package may combine light of three colors to produce white light. In some embodiments, the light emission package may include only a blue LED therein among the above-described LEDs of three colors. In this case, fluorescent members (e.g., phosphors) may be formed in a light emitting unit of the blue LED so as to convert blue light into white light.

The backlight 157 may be one of a direct type backlight 145, an edge type backlight 145, and a corner type backlight 145. For instance, a direct type backlight is illustrated in FIG. 3.

The backlight controller 158 may adjust an amount of a driving current flowing through the light source to control luminance of light emitted from the light source. Meanwhile, when the driving voltage applied to the light source is substantially large, a duty ratio of the driving current is required, to be decreased considerably so as to keep a predetermined amount of the driving current. In this case, the light source may not be turned on, when the duty ratio is decreased below a certain value. Accordingly, when the duty ratio of the driving current becomes less than a predetermined reference duty ratio, the backlight controller 158 may increase the duty ratio of the driving current to be greater than the reference duty ratio, but reduce a length of an output period of the driving current. In this case, the backlight controller 158 may receive a digital dimming signal that defines a length, of an output period of the driving current from the pulse width modulator PWM and may decrease a duty ratio of a digital dimming signal. The driving current is outputted during a high period of the digital dimming signal, and thus when the duty ratio of the digital dimming signal may be decreased, a length of the high period becomes reduced. Accordingly, although the duty ratio of the driving current is increased, an amount of the driving current may maintain its desired value.

For instance, the backlight controller 158 may increase a duty ratio of a driving current n times (n is a natural number greater than 1) its original value and decrease a duty ratio of a digital dimming signal to an nth of its original value. In this case, a value of n may vary according to a reference duty ratio. For instance, n may have a value that satisfies the following condition: n times a duty ratio is greater than or at least equal to a reference duty ratio.

Meanwhile, when a duty ratio of a driving current is greater than or equal to a reference duty ratio, the backlight controller 158 may maintain the duty ratio of the driving current and may not modulate a duty ratio of a digital dimming signal applied from the pulse width modulator PWM and output the duty ratio.

Figure 4:
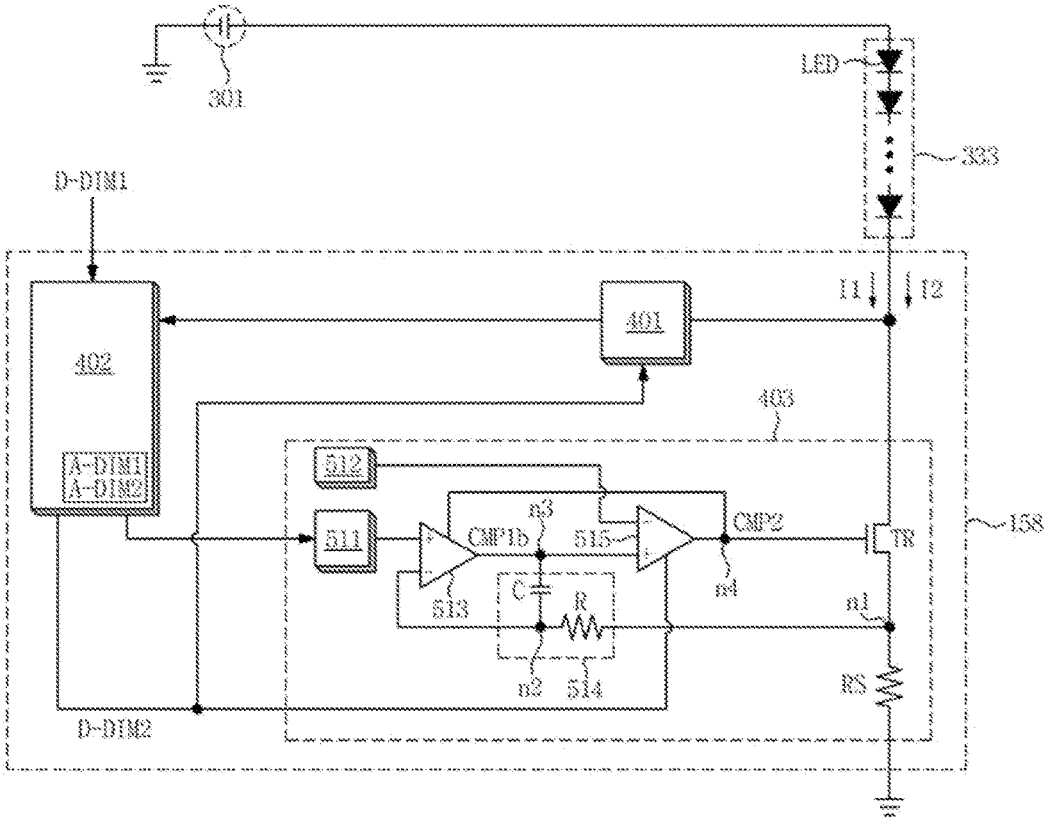
FIG. 4 is a detailed configuration view illustrating a backlight controller of FIG. 1.

FIG. 4 is a detailed configuration view illustrating the backlight controller 158 of FIG. 1.

The backlight controller 158 may include, as illustrated in FIG. 4, a duty ratio calculator 401, a dimming controller 402, and a light source controller 403.

The duty ratio calculator 401 may detect a driving current I1 flowing through the light source and calculate a duty ratio of the detected driving current I1. For this purpose, the duty ratio calculator 401 may be connected to one side of the light source array LA. For instance, the duty ratio calculator 401 may be connected to a cathode terminal of a backmost light source among a plurality of light sources of the light source array LA. Herein, the backmost light source refers to a light source disposed farthest from the DC power source 301 among the plurality of light sources. Meanwhile, the duty ratio calculator 401 may receive a digital dimming signal outputted from D-DIM2 output from the dimming controller 402 and detect the driving current I1 during a high period of the digital dimming signal D-DIM2. In other words, the duty ratio calculator 401 may calculate a duty ratio of the driving current I1 generated during the high period of the digital dimming signal D-DIM2.

The dimming controller 402 may receive information on the duty ratio of the driving current I1 from the duty ratio calculator 401. Further, the dimming controller 402 may receive a digital dimming signal D-DIM1 from the external pulse width modulator PWM. The dimming controller 402 may compare the duty ratio of the driving current I1 and a predetermined reference duty ratio. When the duty ratio of the driving current I1 is less than the reference duty ratio, the dimming controller 402 may increase voltage of an analog dimming signal generated there inside and decrease the duty ratio of the digital dimming signal D-DIM1 applied from the external pulse width modulator PWM. For instance, the dimming controller 402 may increase voltage of the analog dimming signal n times its original value and decrease the duty ratio of the digital dimming signal D-DIM1 to an nth of its original value. Herein, the analog dimming signal may be a DC voltage and the digital dimming signal may be a pulse voltage.

In more detail, the dimming controller 402 may be prestored with two analog dimming signals A-DIM1 and A-DIM2 having voltage levels different from each other there inside. When the two analog dimming signals A-DIM1 and A-DIM2 are respectively referred to as a first analog dimming signal A-DIM1 and a second analog dimming signal A-DIM2, voltage of the second analog dimming signal A-DIM2 may be n times greater than voltage of the first analog dimming signal A-DIM1. The dimming controller 402 may initially output the first analog dimming signal A-DIM1. When the duty ratio of the driving current I1 is less than the reference duty ratio as described above, the dimming controller 402 may select the second analog dimming signal A-DIM2 and output it, instead of the first analog dimming signal A-DIM1.

Meanwhile, when a duty ratio of the driving current I1 is greater than or equal to a reference duty ratio, the dimming controller 402 may operate as follows.

First, when a duty ratio of the driving current I1 does not have a history of being dropped below a reference duty ratio and is large from the beginning, the dimming controller 402 may select the first analog dimming signal A-DIM1 there inside and output the digital dimming signal D-DIM1 applied from the external pulse width modulator PWM without modulation.

Second, when a duty ratio of the driving current I1 is at least once dropped below a reference duty ratio and then becomes greater than or equal to the reference duty ratio by the second analog dimming signal, the dimming controller 402 may output an analog dimming signal of which voltage is increased n times its original, value (i.e., a second analog dimming signal A-DIM2) and may decrease a duty ratio of the digital dimming signal D-DIM1 applied from the external pulse width modulator PWM to an nth of its original value and output it.

The analog dimming signal and the digital dimming signal D-DIM2 outputted from the dimming controller 402 may be provided to the light source controller 403. Further, the digital dimming signal D-DIM2 outputted from the dimming controller 402 may be provided to the duty ratio calculator 401.

The light source controller 403 may receive the analog dimming signal and the digital dimming signal D-DIM2 from the dimming controller 402. The light source controller 403 may determine a duty ratio of the driving current according to the analog dimming signal and apply the driving current I2 to the light sources during a high period of the digital dimming signal D-DIM2.

The light source controller 403 may include, as illustrated in FIG. 4, a sensing resistor Rs, an integrator 514, a voltage divider 511, a first comparator 513, an oscillator 512, a second comparator 515, and a static current switching element TR.

The sensing resistor Rs may produce a sensing voltage by the driving current. The sensing resistor Rs may be connected between a first node n1 and ground.

The integrator 514 may be configured to integrate the sensing voltage to thereby output a DC sensing voltage. The integrator 514 may include a resistor and a capacitor. The resistor may be connected between the first node n1 and a second node n2 and the capacitor may be connected between the second node n2 and a third node n3.

The voltage divider 511 may divide voltage of the analog dimming signal applied from the dimming controller 402 and output the divided analog dimming signal to the first comparator 513.

The first comparator 513 may compare the integrated sensing voltage applied from the integrator 514 with the divided analog dimming signal applied from the voltage divider 511, to thereby output a first comparison signal. In this case, the first comparator 513 may output the first comparison signal during a high period of a second comparison signal. An inverting terminal (−) of the first comparator 513 may be connected to the second node n2, a non-inverting terminal (+) of the first comparator 513 may be connected to the voltage divider 511, an output terminal of the first comparator 513 may be connected to the third node n3, and a control terminal of the first comparator 513 may be connected to the fourth node n4. The first comparator 513 may be a differential amplifier.

The oscillator 512 may output a ramp signal. The ramp signal may have a frequency higher than that of a digital dimming signal inputted to the dimming controller 402.

The second comparator 515 may compare the first comparison signal applied from the first comparator 513 with the ramp signal applied from the oscillator 512, to thereby output a second comparison signal. In this case, the second comparator 515 may output the second comparison signal during a high period of the digital dimming signal applied from the dimming controller 402. A non-inverting terminal (+) of the second comparator 515 may be connected to the third node n3, an inverting terminal (−) of the second comparator 515 may be connected to the oscillator 512, an output terminal of the second comparator 515 may be connected to the fourth node n4, and a control terminal of the second comparator 515 may be connected to the dimming controller 402. The second comparator 515 may be a differential amplifier.

The static current switching element TR may control the driving current according to the second comparison signal outputted from the second comparator 515. A gate terminal of the static current switching element TR may be connected to the fourth node n4, a drain terminal of the static current switching element TR may be connected to the light source array, and a source terminal of the static current switching element TR may be connected to the first node n1.

Hereinafter, operation of the backlight controller 158 is described below in detail with reference to FIGS. 4 to 6.

Figure 5:
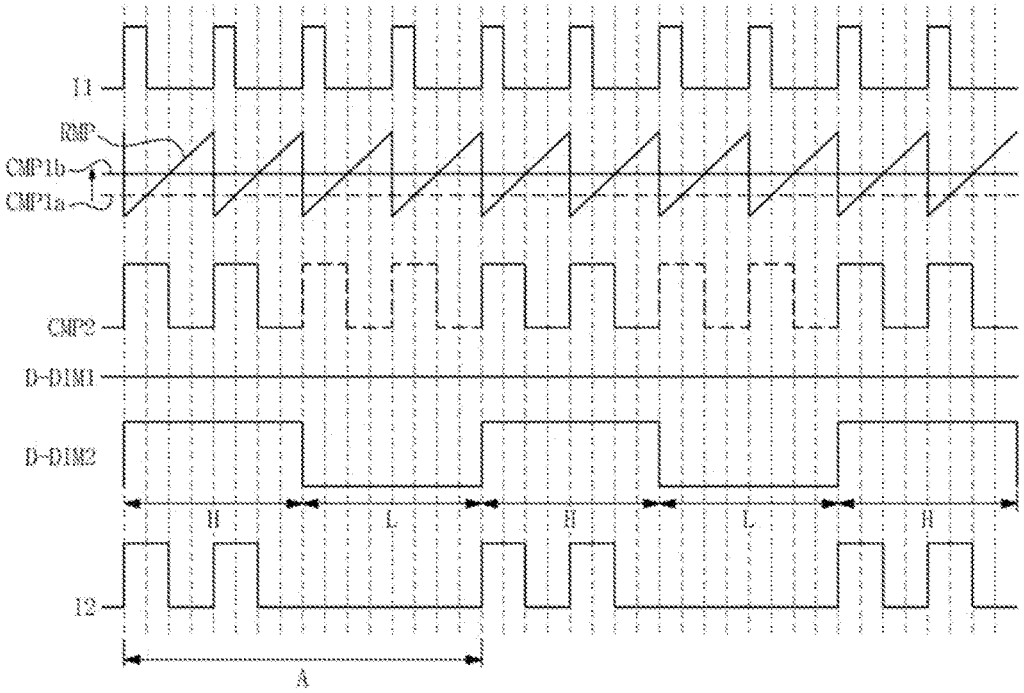
FIG. 5 is a waveform diagram illustrating wavelengths of a plurality of signals pertaining to operation of the backlight controller of FIG. 4.

FIG. 5 is a waveform diagram illustrating wavelengths of a plurality of signals pertaining to operation of the backlight controller 158 of FIG. 4. FIG. 6 is a flow chart illustrating a sequence of the operation of the backlight controller 158 of FIG. 4.

First, it is assumed that a reference duty ratio is 30%. As illustrated in S1, S2, and S5 of FIG. 6, when a duty ratio of the driving current I1 calculated by the duty ratio calculator 401 is greater than the reference duty ratio, the duty ratio of the current driving current I1 and the duty ratio of the digital dimming signal D-DIM1 are maintained. For this purpose, the dimming controller 402 may output the first analog dimming signal A-DIM1, which is set to be a default value, and output the digital dimming signal D-DIM1 applied from the external pulse width modulator PWM without modulation. For instance, when a duty ratio of the digital dimming signal D-DIM1 applied from the external pulse width modulator PWM is 100%, the dimming controller 402 may output the digital dimming signal D-DIM1 having a duty ratio of 100% without modulation.

Figure 6:
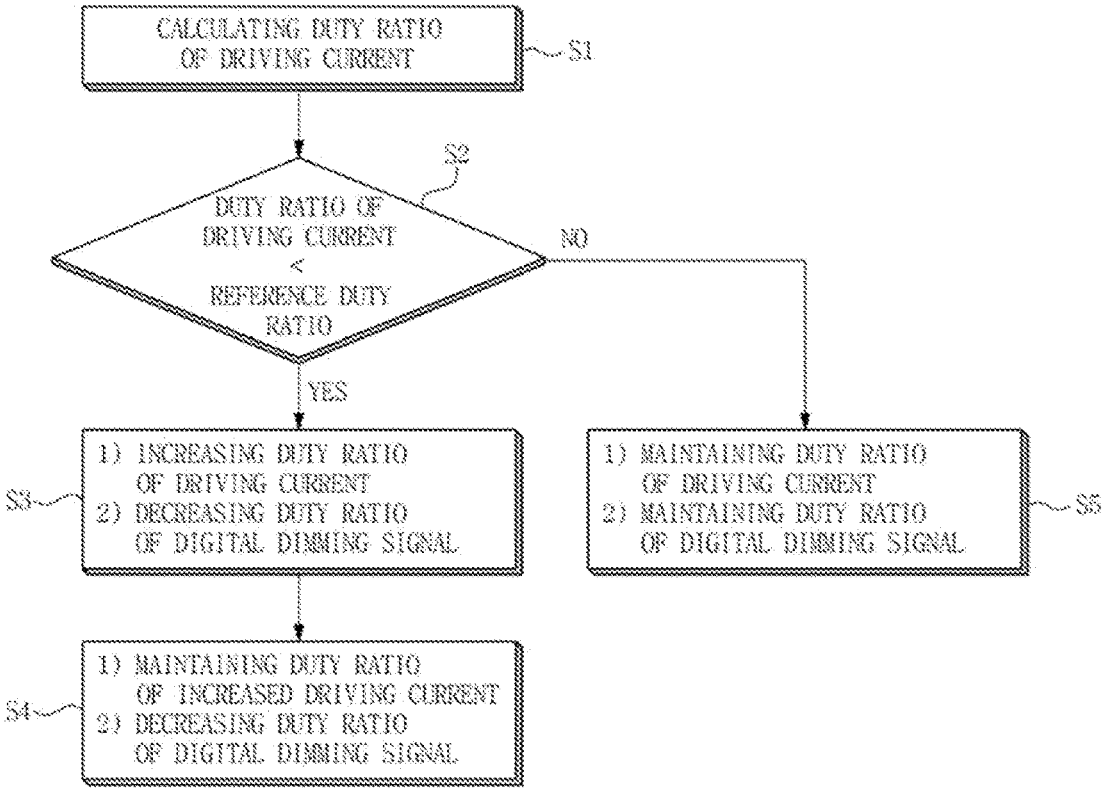
FIG. 6 is a flow chart illustrating a sequence of the operation of the backlight controller of FIG. 4.

However, as illustrated in FIG. 4 and S1, S2, and S3 of FIG. 6, when a duty ratio of the driving current I1 calculated by the duty ratio calculator 401 is, for example, 25%, which is less than the above duty ratio of 30%, the duty ratio of the currently detected driving current I1 may be increased greater than the reference duty ratio, but a duty ratio of the currently input digital dimming signal D-DIM1 may be decreased. For this purpose, the dimming controller 402 may increase voltage of the analog dimming signal. For instance, when a voltage of the second analog dimming signal A-DIM2 is two times greater than a voltage of the first analog dimming signal A-DIM1, the dimming controller 402 may select the second analog dimming signal A-DIM2, instead of the first analog dimming signal A-DIM1, and output it. Further, the dimming controller 402 may perform modulation of the digital dimming signal D-DIM1 applied from the external pulse width modulator PWM. For instance, the dimming controller may decrease a duty ratio of the digital dimming signal D-DIM1 to half the original value. Accordingly, a first digital dimming signal D-DIM1 having a duty ratio of 100% is modulated to a second digital dimming signal D-DIM2 having a duty ratio of 50%.

The second analog dimming signal A-DIM2 and the second digital dimming signal D-DIM2 outputted from the dimming controller 402 may be provided to the light source controller 403. That is, the second analog dimming signal A-DIM2 may be divided by the voltage divider 511, and then inputted to the non-inverting terminal (+) of the first comparator 513. Next, the second digital dimming signal D-DIM2 may be inputted to the control terminal of the second comparator 515.

Meanwhile, the first comparator 513 may receive the sensing voltage from the sensing resistor Rs and the integrator 514. The sensing voltage is inputted to the inverting terminal (−) of the first comparator 513. Herein, the sensing voltage detected by the sensing resistor Rs is a voltage that corresponds to the driving current I1 and may have a pulse waveform. However, the sensing voltage of the pulse waveform may be converted to a DC sensing voltage by the integrator 514.

The first comparator 513 may amplify a difference between the second analog dimming signal A-DIM2 and the sensing voltage and output it. The output of the first comparator 513 is a first comparison signal CMP1*b*. The first comparison signal CMP1*b* generated by the first comparator 513 based on the second analog dimming signal A-DIM2 may have a value greater than the first comparison signal CMP1*a* generated by the first comparator 513 based on the first analog dimming signal A-DIM1. That is because a voltage of the second analog dimming signal A-DIM2 is greater than a voltage of the first analog dimming signal A-DIM1.

The second comparator 515 may amplify a difference between the first comparison signal CMP1*b* generated by the first comparator 513 and the ramp signal RMP provided by the oscillator 512 and output it. The output of the second comparator 515 is a second comparison signal CMP2. The second comparison signal CMP2 has a pulse waveform. That is, when the ramp signal RMP is greater than the first comparison signal CMP1*b*, the second comparison signal CMP2 may have a high voltage. In contrast, when the ramp signal RMP is less than the first comparison signal CMP1*b*, the second comparison signal CMP2 may have a low voltage. The second comparison signal CMP2 generated by the second comparator 515 based on the second analog dimming signal A-DIM2 may have a duty ratio greater than that of the second comparison signal generated by the second comparator 515 based on the first analog dimming signal A-DIM1.

Meanwhile, the second comparator 515 may be controlled according to the digital dimming signal applied from the dimming controller 402. That is, when the digital dimming signal is a high voltage, the second comparator 515 may be turned on. In contrast, when the digital dimming signal is a log voltage, the second comparator 515 may be turned off. For instance, when the second digital dimming signal D-DIM2 having a duty ratio of 50% is applied to the second comparator 515 as described above, the second comparator 515 may be turned on during a high period of the second digital dimming signal D-DIM2 and turned off during a low period L thereof. Accordingly, during the low period L of the second digital dimming signal D-DIM2, pulses of the second comparison signal CMP2 (dotted lines) are all blocked.

The second comparison signal applied from the second comparator 515 may be inputted to the control terminal of the first comparator 513 and the gate terminal of the static current switching element TR. When the second comparison signal has a high voltage, the first comparator 513 and the static current switching element TR may be turned on. In contrast, when the second comparison signal CMp2 has a low voltage, the first comparator 513 and the static current switching element TR may be turned off. The first comparator 513 may output a first comparison signal when having on state and may not output a first comparison signal when having off state. The static current switching element TR may apply the driving current I2 to the light source array LA when having on state and may not apply the driving current I2 to the light source array LA when having off state. Accordingly, the static current switching element TR operated by the second comparison signal CMP2 may produce a driving current that has a duty ratio two times greater than that of the initial driving current and has an output period shorter than that of the initial driving current (S3). Accordingly, as the duty ratio of the driving current is increased greater than the reference duty ratio, the light sources of the light source array LA may be normally turned on an off and the output period of the driving current I2 may be shortened in accordance with an increase in the duty ratio, thereby capable of maintaining an amount of the driving current to a desired value. For instance, as illustrated in FIG. 5, an average value of the first driving current I1 and an average value of the second driving current I2 during a period A are the same.

Meanwhile, as the driving current I2 is applied to the light source array LA, the duty ratio calculator 401 may calculate a duty ratio of the driving current I2. In this case, the duty ratio of the driving current I2 may be larger than a reference duty ratio. Accordingly, as illustrated in S4, the increased duty ratio of the driving current I2 may be maintained. However, the duty ratio of the digital dimming signal D-DIM1 applied from the pulse width modulator PWM may be decreased. This is because the duty ratio of the driving current I1 has history of being decreased below the reference value.

Figure 7:
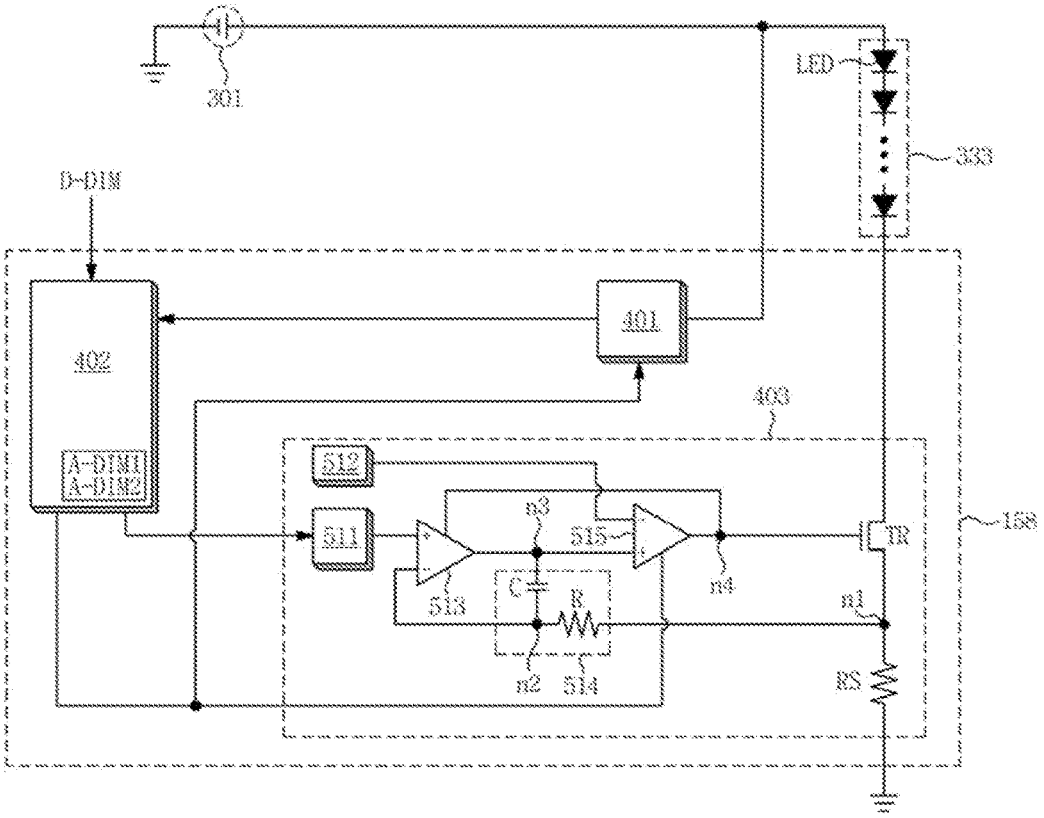
FIG. 7 is a schematic view illustrating a backlight controller of FIG. 1 according to another exemplary embodiment.

FIG. 7 is a schematic view illustrating a backlight controller of FIG. 1 according to another exemplary embodiment.

The backlight controller 158 of FIG. 7 may include a duty ratio calculator 401, a dimming controller 402, and a light source controller 403.

As illustrated in FIG. 7, the duty ratio calculator 401 may be connected to an anode terminal of a light source instead of a cathode terminal thereof.

The duty ratio calculator 401, the dimming controller 402, and the light source controller 403 illustrated in FIG. 7 are substantially identical to the duty ratio calculator 401, the dimming controller 402, and the light source controller 403 illustrated in FIG. 4. Therefore repeated description will not be provided.

Figure 8:
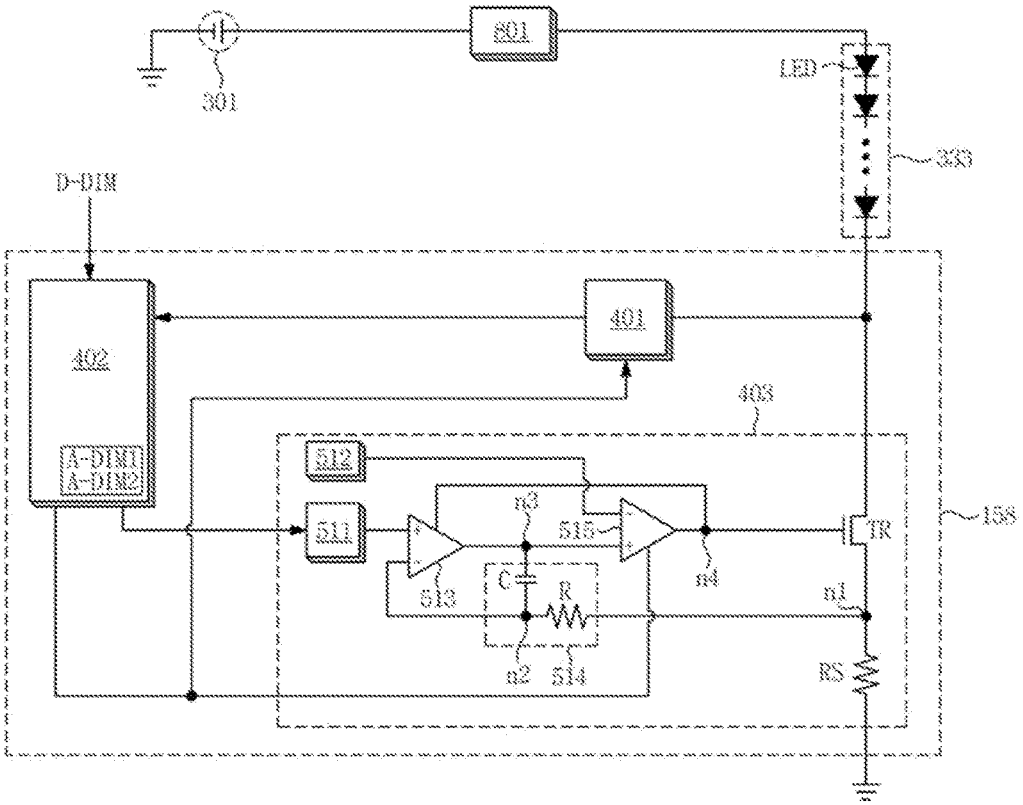
FIG. 8 is a schematic view illustrating a backlight controller of FIG. 1 according to yet another exemplary embodiment.

FIG. 8 is a schematic view illustrating a backlight controller 158 of FIG. 1 according to yet another exemplary embodiment.

The backlight controller 158 of FIG. 8 may include a duty ratio calculator 401, a dimming controller 402, a light source controller 403, and a voltage converter 801.

The voltage converter 801 may be configured to convert DC voltage applied from the DC power source 301. That is, the voltage converter 801 may increase or decrease the DC voltage to output the increased or decreased voltage to LEDs of a light source array LA. The DC converter 801 may be selectively used when the DC voltage applied from the DC power source is less than or more than a desired voltage. The DC converter 801 may be set up to output a desired voltage before the backlight controller 158 starts operation. In other words, voltage applied from the DC converter 801 is a constant DC voltage. Accordingly, voltage outputted from the DC converter 801 is not converted in the dimming process.

The duty ratio calculator 401, the dimming controller 402, and the light source controller 403 illustrated in FIG. 8 are substantially identical to the duty ratio calculator 401, the dimming controller 402, and the light source controller 403 illustrated in FIG. 4. Therefore repeated description will not be provided.

Figure 9:
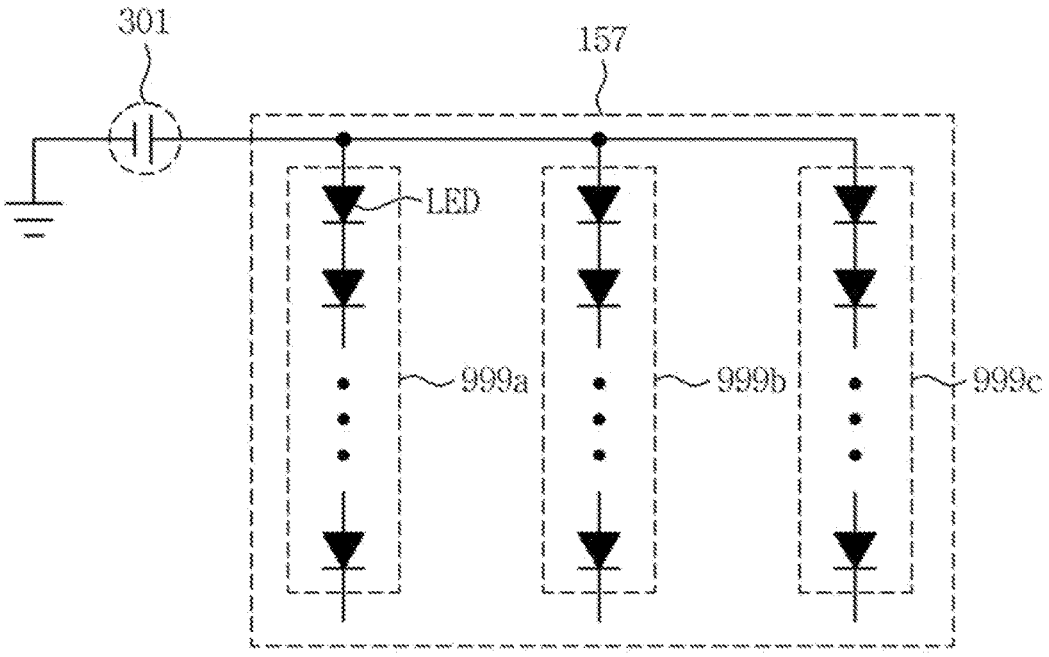
FIG. 9 is a schematic view illustrating a backlight of FIG. 1 according to another exemplary embodiment.

FIG. 9 is a schematic view illustrating a backlight of FIG. 1 according to another exemplary embodiment.

The backlight 157 of FIG. 9 may include a plurality of LED arrays 999*a*, 999*b*, and 999*c* connected in parallel.

Each of the LED arrays 999*a*, 999*b*, and 999*c* may include a plurality of light sources. The light sources of one LED array LA may be connected to each other in series. The light source arrays 999*a*, 999*b*, and 999*c* may emit light by a plurality of driving currents generated based on a DC voltage generated by a DC power source 301. For example, LEDs of a first LED array LA1 may emit light based on a first driving current, LEDs of a second LED array LA2 may emit light based on a second driving current, and LEDs of a third LED array LA3 may emit light based on a third driving current. The driving currents may be controlled by a backlight controller 158.

The light source illustrated in FIG. 9 is substantially the same as the light source illustrated in FIG. 3. Thus, the repeated description of the light source will not be provided.

Figure 10:
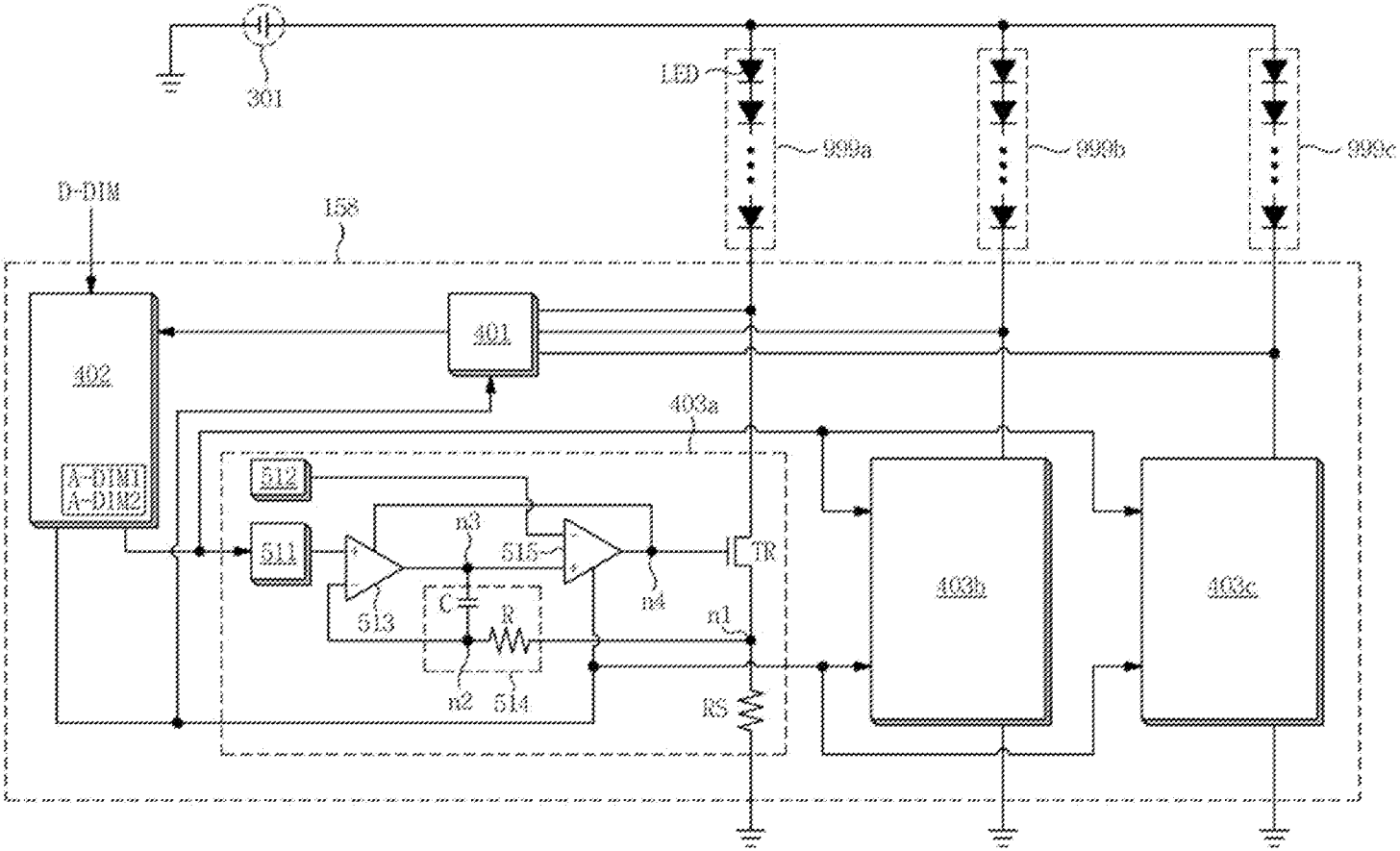
FIG. 10 is a detailed configuration view illustrating a backlight controller for controlling the backlight of FIG. 9 according to one exemplary embodiment.
Figure 11:
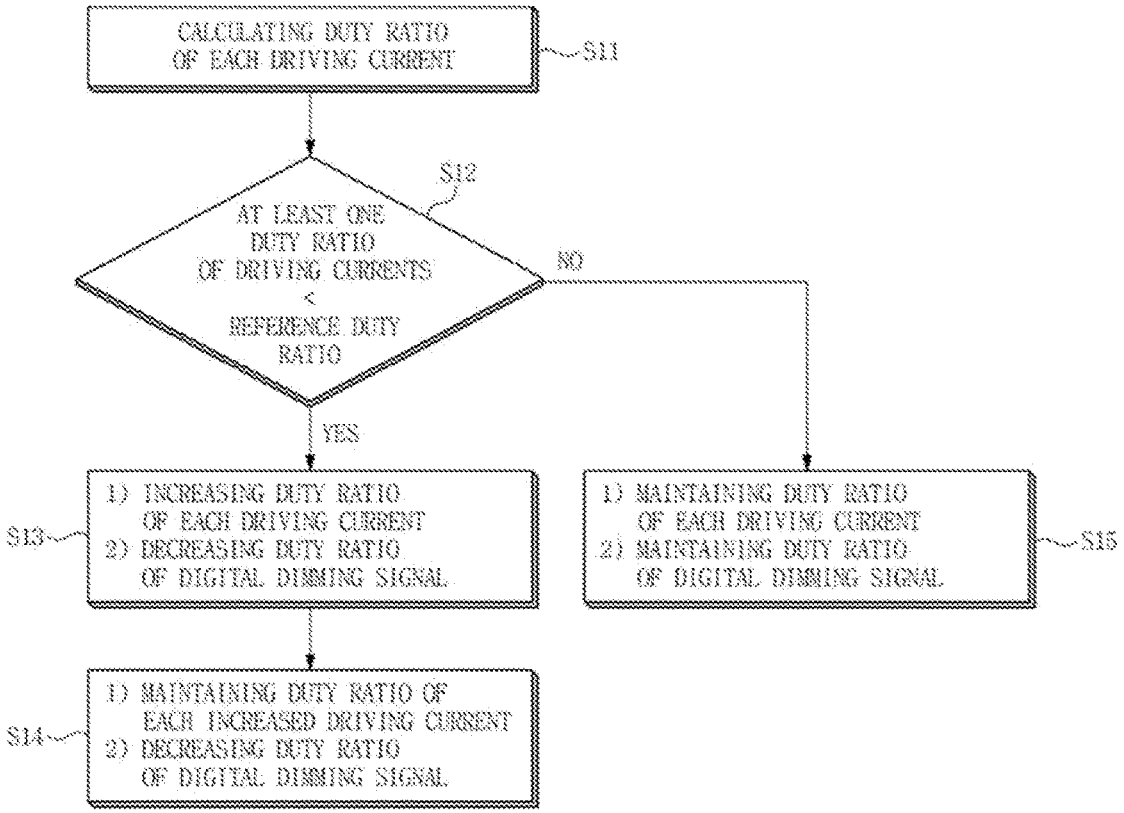
FIG. 11 is a flow chart illustrating a sequence of operation of the backlight controller of FIG. 10.

FIG. 10 is a detailed configuration view illustrating a backlight controller 158 for controlling the backlight of FIG. 9 according to one exemplary embodiment. FIG. 11 is a flow chart illustrating a sequence of operation of the backlight controller 158 of FIG. 10.

The backlight controller 158 illustrated in FIG. 10 may calculate a duty ratio of each driving current (S11). When at least one of the duty ratios of driving currents is less than a reference duty ratio (S12), the backlight controller 158 may increase the duty ratio of each driving current greater than the reference duty ratio, and decrease a duty ratio of a digital dimming signal applied from an external pulse width modulator PWM (S13). For instance, the backlight controller 158 illustrated in FIG. 10 may increase a duty ratio of each driving current n times its original value and decrease a duty ratio of a digital dimming signal to an nth of its original, value.

The backlight controller 158 illustrated in FIG. 10 may include a duty ratio calculator 401, a dimming controller 402, and a plurality of LED controllers 403*a*, 403*b*, and 403*c*.

The duty ratio calculator 401 may detect each driving current flowing through each LED array and calculate a duty ratio of each detected driving current (S11). For this purpose, the duty ratio calculator 401 may be connected to one side of each of the LED arrays 999*a*, 999*b*, and 999*c*. For instance, the duty ratio calculator 401 may be connected to a cathode terminal of a backmost light source among a plurality of light sources of each of the LED arrays 999*a*. 999*b*, and 999*c*. Herein, the backmost light source refers to a light source disposed farthest from the DC power source 301 among the plurality of light sources. Meanwhile, the duty ratio calculator 401 may receive a digital dimming signal outputted through the dimming controller 402 and detect each driving current during a high period of the digital dimming signal. That is, the duty ratio calculator 401 may calculate a duty ratio of each driving current generated during the high period of the digital dimming signal.

The dimming controller 402 may receive information about the duty ratio of each driving current from the duty ratio calculator 401. Further, the dimming controller 402 may receive a digital dimming signal from the external pulse width modulator PWM. The dimming controller 402 may compare the duty ratio of each driving current and a predetermined reference duty ratio. When at least one of the duty ratios of the driving current is less than the reference duty ratio, the dimming controller 402 may increase voltage of an analog dimming signal and decrease the duty ratio of the digital dimming signal provided by the external pulse width modulator PWM. For instance, the dimming controller 402 may increase voltage of the analog dimming signal n times its original value and decrease the duty ratio of the digital dimming signal to an nth of its original value.

In more detail, the dimming controller 402 may be prestored with two analog dimming signals A-DIM1 and A-DIM2 having voltage levels different from each other there inside. When the two analog dimming signals A-DIM1 and A-DIM2 are respectively referred to as a first analog dimming signal A-DIM1 and a second analog dimming signal A-DIM2, voltage of the second analog dimming signal A-DIM2 may be n times greater than voltage of the first analog dimming signal A-DIM1. The dimming controller 402 may initially output the first analog dimming signal A-DIM1. When at least one of the duty ratios of the driving currents is less than the reference duty ratio as described above, the dimming controller 402 may select the second analog dimming signal A-DIM2 and output it, instead of the first analog dimming signal A-DIM1.

Meanwhile, when all of the duty ratios of the driving currents are greater than or equal to a reference duty ratio, the dimming controller 402 may operate as follows.

First, when all duty ratios of the driving currents do not have a history of being dropped below a reference duty ratio and is large from the beginning, the dimming controller 402 may select the first analog dimming signal A-DIM1 there inside and output the digital dimming signal D-DIM1 applied from the external pulse width modulator PWM without modulation.

Second, when at least one of the duty ratios of the driving currents is at least once dropped below a reference duty ratio and then becomes greater than or equal to the reference duty ratio by the second analog dimming signal, the dimming controller 402 may output an analog dimming signal of which voltage is increased n times its original value (i.e., a second analog dimming signal DIM2) and may decrease a duty ratio of the digital dimming signal applied from the external pulse width modulator PWM to an nth of its original, value and output it.

The analog dimming signal and the digital dimming signal outputted from the dimming controller 402 may be provided to the light source controller 403. Further, the digital dimming signal outputted from the dimming controller 402 may be provided to the duty ratio calculator 401.

Each LED controller 403 may receive the analog dimming signal and the digital dimming signal from the dimming controller 402. Each LED controller 403 may determine a duty ratio of each driving current according to the analog dimming signal and determine a length of an output period of the driving current according to the digital dimming signal. For instance, each LED controller 403 may increase the duty ratio of each driving current greater than the reference duty ratio in response to the analog dimming signal with an, increased voltage. Then, each LED controller 403 may apply each driving current to each LED array during a high period of the digital dimming signal with a decreased duty ratio.

Each LED controller 403 may include, as illustrated in FIG. 10, a sensing resistor Rs, an integrator 514, a voltage divider 511, a first comparator 513, an oscillator 512, a second comparator 515, and a static current switching element TR.

Each of the LED controllers 403*a*, 403*b*, and 403*c* illustrated in FIG. 10 is substantially the same as the light source controller 403 illustrated in FIG. 3, and thus repeated description will not be provided.

Figure 12:
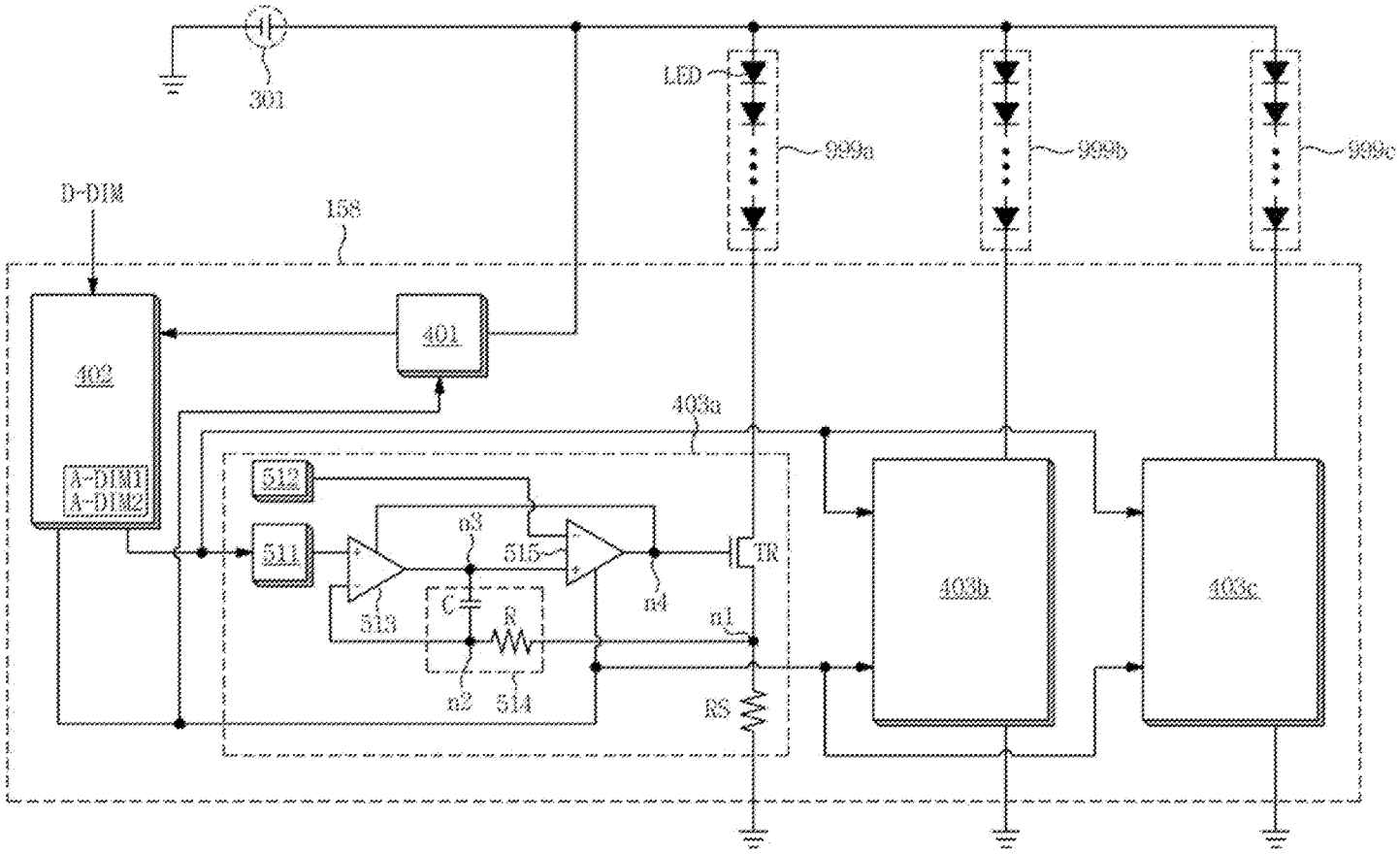
FIG. 12 is a detailed configuration view illustrating a backlight controller for controlling the backlight of FIG. 9 according to another exemplary embodiment.

FIG. 12 is a detailed configuration view illustrating a backlight controller 158 for controlling the backlight of FIG. 9 according to another exemplary embodiment.

The backlight controller 158 illustrated in FIG. 12 may include a duty ratio calculator 401, a dimming controller 402, and a plurality of LED controllers 403*a*, 403*b*, and 403*c*.

As illustrated in FIG. 12, the duty ratio calculator 401 may be connected to an anode terminal of a light source, instead of a cathode terminal thereof.

The duty ratio calculator 401, the dimming controller 402, and the plurality of LED controllers 403*a*, 403*b*, and 403*c* illustrated in FIG. 12 are substantially identical to the duty ratio calculator 401, the dimming controller 402, and the plurality of LED controllers 403*a*, 403*b*, and 403*c* illustrated in FIG. 10, and thus repeated description will not be provided.

Figure 13:
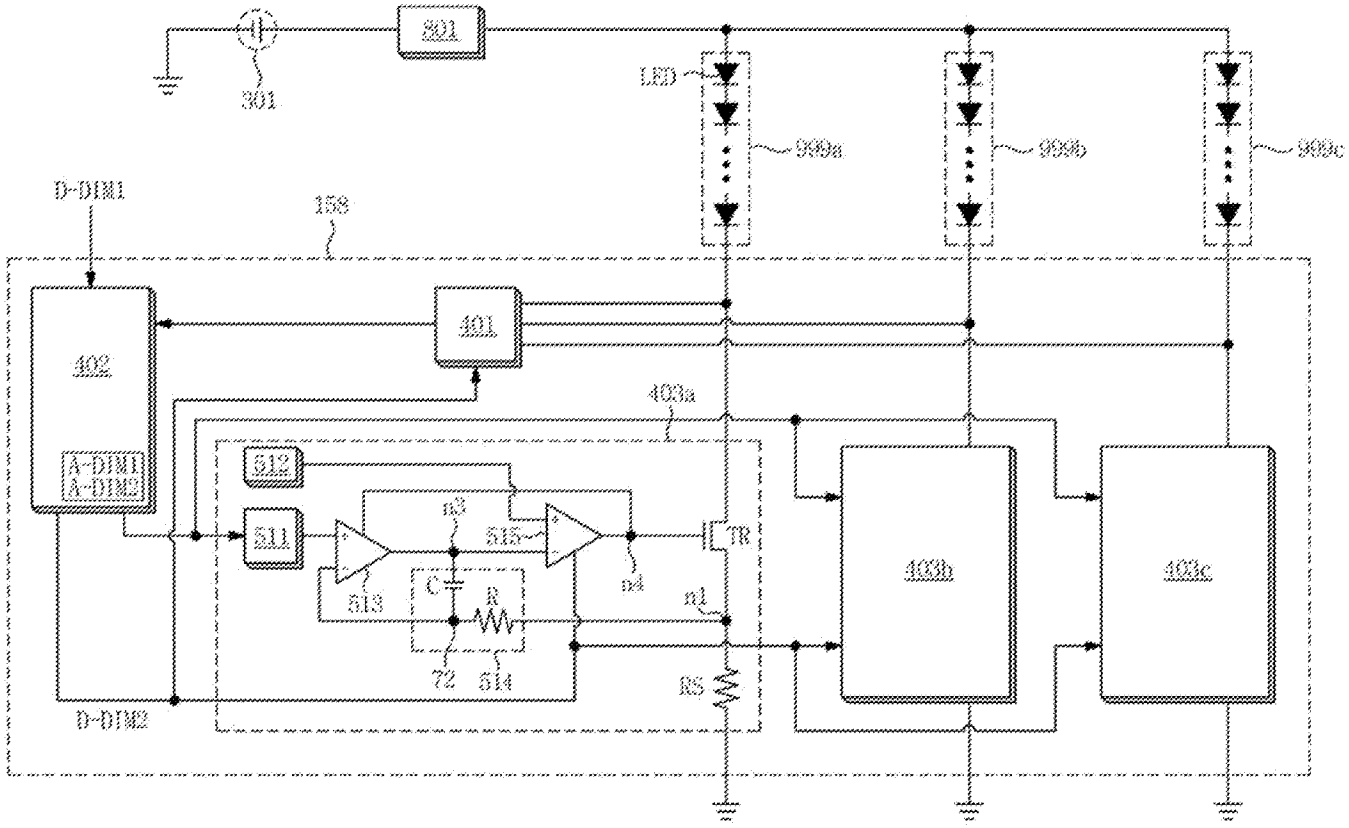
FIG. 13 is a detailed configuration view illustrating a backlight controller for controlling the backlight of FIG. 9 according to yet another exemplary embodiment.

FIG. 13 is a detailed configuration view illustrating a backlight controller 158 for controlling the backlight of FIG. 9 according to yet another exemplary embodiment.

The backlight controller 158 illustrated in FIG. 13 may include a duty ratio calculator 401, a dimming controller 402, a plurality of LED controllers 403*a*, 403*b*, and 403*c*, and a voltage converter 801.

The voltage converter 801 may increase or decrease DC voltage applied from a DC power source 301 to provide the increased or decreased voltage to LEDs of LED arrays 999*a*, *b*, and 999*c*.

The duty ratio calculator 401, the dimming controller 402, and the light source controller 403 illustrated in FIG. 13 are substantially identical to the duty ratio calculator 401, the dimming controller 402, and the plurality of LIED controllers 403*a*, 403*b*, and 403*c* illustrated in FIG. 10, and thus repeated description will not be provided.

Meanwhile, the backlight unit illustrated in FIGS. 7 to 12 may further include a DC converter 801. In this case, the DC converter 801 may be connected between a DC power source 301 and a detect terminal of the duty ratio calculator 401. Herein, the detect terminal refers to a connection point between an anode terminal of the light source and the duty ratio calculator 401.

From the foregoing, it will be appreciated that various embodiments in accordance with the present disclosure have been described herein for purposes of illustration, and that various modifications may be made without departing from the scope and spirit of the present teachings. Accordingly, the various embodiments disclosed herein are not intended to be limiting of the true scope and spirit of the present teachings. Various features of the above described and other embodiments can be mixed and matched in any manner, to produce further embodiments consistent with the invention.

What is claimed is:

1. A backlight unit, comprising:

a light source configured to emit light based on a driving current; and a backlight controller configured to receive, from a pulse width modulator, a digital dimming signal that defines a length of an output period of the driving current, wherein the backlight controller, when a duty ratio of the driving current is less than a reference duty ratio, modulates the duty ratio of the driving current so that the duty ratio of the driving current is equal to or greater than the reference duty ratio and decreases a duty ratio of the digital dimming signal.

2. The backlight unit of claim 1, wherein the backlight controller increases the duty ratio of the driving current n times (n is a natural number greater than 1) its original duty ratio and decreases the duty ratio of the digital dimming signal to an nth of its original duty ratio.

3. A backlight unit, comprising:

a light source configured to emit light based on a driving current; and a backlight controller configured to receive, from a pulse width modulator, a digital dimming signal that defines a length of an output period of the driving current, wherein the backlight controller, when a duty ratio of the driving current is less than a reference duty ratio, modulates the duty ratio of the driving current so that the duty ratio of the driving current is equal to or greater than the reference duty ratio and decreases a duty ratio of the digital dimming signal, wherein the backlight controller comprises:

a dimming controller configured to, when a duty ratio of the driving current is less than a reference duty ratio, increase voltage of an analog dimming signal and decrease a duty ratio of the digital dimming signal applied from the pulse width modulator;

a duty ratio calculator configured to, during a high period of the digital dimming signal applied from the dimming controller, calculate a duty ratio of the driving current and provide the calculated duty ratio to the dimming controller; and a light source controller configured to receive the analog dimming signal and the digital dimming signal from the dimming controller, to increase the duty ratio of the driving current greater than the reference duty ratio in response to the analog dimming signal with an increased voltage, and to apply the driving current to the light source during a high period of the digital dimming signal with a decreased duty ratio.

4. The backlight unit of claim 3, wherein the dimming controller increases voltage of the analog dimming signal n times (n is a natural number greater than 1) its original voltage and decreases a duty ratio of the digital dimming signal to an nth of its original duty ratio.

5. The backlight unit of claim 3, wherein the light source controller comprises:

a sensing resistor configured to generate a sensing voltage based on the driving current;

an integrator configured to integrate the sensing voltage;

a first comparator configured to compare the sensing voltage integrated by the integrator and the analog dimming signal applied from the dimming controller to thereby generate a first comparison signal, and to output the first comparison signal during a high period of a second comparison signal;

an oscillator configured to output a ramp signal;

a second comparator configured to compare the first comparison signal applied from the first comparator and the ramp signal applied from the oscillator to thereby generate a second comparison signal, and to output the second comparison signal during a high period of the digital dimming signal applied from the dimming controller; and a static current switching element configured to control the driving current according to the second comparison signal outputted from the second comparator.

6. The backlight unit of claim 5, wherein the integrator comprises:

a resistor connected between the sensing resistor and an input terminal of the first comparator; and a capacitor connected between an output terminal of the first comparator and the input terminal of the first comparator.

7. The backlight unit of claim 5, wherein the light source controller further comprises a voltage divider configured to divide the analog dimming signal applied from the dimming controller and output the divided analog dimming signal to the first comparator.

8. The backlight unit of claim 3, further comprising a direct current (DC) power source connected to the light source.

9. The backlight unit of claim 3, further comprising:

a DC power source; and a voltage converter configured to increase or decrease a DC voltage applied from the DC power source to apply the increased or decreased DC voltage to the light source.

10. The backlight unit of claim 3, wherein the duty ratio calculator is connected to one of a cathode terminal and an anode terminal of the light source.

11. The backlight unit of claim 3, wherein the light source is a light emitting diode (LED).

12. A backlight unit, comprising:

a plurality of light sources configured to emit light based on a plurality of driving currents and connected in parallel; and a backlight controller configured to receive, from a pulse width modulator, a digital dimming signal that defines lengths of output periods of the driving currents, wherein the backlight controller, when at least one of duty ratios of the driving currents is less than a reference duty ratio, modulates the duty ratio of each driving current so that the duty ratio of each driving current is equal to or greater than the reference duty ratio and decreases the duty ratio of the digital dimming signal.

13. The backlight unit of claim 12, wherein the backlight controller increases the duty ratio of each driving current n times (n is a natural number greater than 1) its original duty ratio and decreases the duty ratio of the digital dimming signal to an nth of its original duty ratio.

14. A backlight unit, comprising:

a plurality of light sources configured to emit light based on a plurality of driving currents and connected in parallel; and a backlight controller configured to receive, from a pulse width modulator, a digital dimming signal that defines lengths of output periods of the driving currents, wherein the backlight controller, when at least one of duty ratios of the driving currents is less than a reference duty ratio, modulates the duty ratio of each driving current so that the duty ratio of each driving current is equal to or greater than the reference duty ratio and decreases the duty ratio of the digital dimming signal, wherein the backlight controller comprises:

a dimming controller configured to, when at least one of duty ratios of the driving currents is less than a reference duty ratio, increase voltage of an analog dimming signal and decrease a duty ratio of the digital dimming signal applied from the pulse width modulator;

a duty ratio calculator configured to, during a high period of the digital dimming signal applied from the dimming controller, calculate a duty ratio of each of the driving currents and provide the calculated duty ratio to the dimming controller; and a light source controller configured to receive the analog dimming signal and the digital dimming signal from the dimming controller, to increase the duty ratio of each of the driving currents greater than the reference duty ratio in response to the analog dimming signal with an increased voltage, and to apply the driving currents to the light source during a high period of the digital dimming signal with a decreased duty ratio.

15. The backlight unit of claim 14, wherein the dimming controller increases voltage of the analog dimming signal n times (n is a natural number greater than 1) its original voltage and decreases the duty ratio of the digital dimming signal to an nth of its original duty ratio.

* * * * *